US005591927A

United States Patent [19]

Kawamura et al.

[11] Patent Number: 5,591,927

[45] Date of Patent: Jan. 7, 1997

[54] KEYBOARD MUSICAL INSTRUMENT HAVING KEY ACTION MECHANISMS MOVABLE TO AND FROM STRINGS

[75] Inventors: Kiyoshi Kawamura; Taroh Muramatsu; Masahiro Wada; Nobuo Sugiyama; Shinya Koseki, all of Shizuoka-ken, Japan

[73] Assignee: Yamaha Corporation, Japan

[21] Appl. No.: 140,617

[22] Filed: Oct. 22, 1993

Related U.S. Application Data

[63] Continuation-in-part of Ser. No. 123,294, Sep. 17, 1993.

[51] Int. Cl.[6] ..... G10D 15/00

[52] U.S. Cl. ..... 84/171; 108/20

[58] Field of Search ..... 84/216, 219, 220, 84/224, 225, 171, 615, 33, 34, 35, 36; 108/20

[56] References Cited

U.S. PATENT DOCUMENTS

| | | | |
|---|---|---|---|
| 527,533 | 10/1894 | McChesney et al. | 84/220 |
| 533,661 | 2/1895 | McChesney et al. | 84/220 |
| 2,250,065 | 7/1941 | Koel | 84/171 |
| 4,633,753 | 1/1987 | Takahashi | 84/220 |
| 4,704,931 | 11/1987 | Nagai | 84/220 |
| 4,744,281 | 5/1988 | Isozaki | 84/171 |
| 4,970,929 | 11/1990 | Ishida | 84/220 |
| 5,001,339 | 3/1991 | Starkey et al. | 250/229 |
| 5,115,705 | 5/1992 | Monte et al. | 84/617 |
| 5,247,129 | 9/1993 | Nozaki et al. | 84/615 |
| 5,259,326 | 11/1993 | Borgman et al. | 108/20 |
| 5,374,775 | 12/1994 | Kawamura et al. | 84/236 |

FOREIGN PATENT DOCUMENTS

| | | |
|---|---|---|
| 0270966A2 | 6/1988 | European Pat. Off. . |
| 0573963A2 | 12/1993 | European Pat. Off. . |
| 97885 | 10/1897 | Germany . |
| 44782 | 9/1898 | Germany . |
| 3707591C1 | 5/1988 | Germany . |
| T0910077 U | 10/1992 | Italy . |
| 51-67732 | 5/1976 | Japan . |
| 55-55880 | 4/1980 | Japan . |
| 62-32308 | 8/1987 | Japan . |
| 63-97997 | 4/1988 | Japan . |

*Primary Examiner*—Cassandra C. Spyrou
*Attorney, Agent, or Firm*—Graham & James LLP

[57] ABSTRACT

A keyboard musical instrument allowing a player to perform using acoustic tones or electronic sounds is provided. The keyboard is movable between various positions, such as between a raised and a lowered position. In an electronic sound mode, the keyboard is lowered so as to increase a gap between hammer assemblies and associated strings. The keyboard is lowered using cams or lifters to pull down the keyboard so as to increase a gap between hammer assemblies and associated strings. In this mode, each hammer assembly rebounds on a stopper when a corresponding key is selected, thereby giving a desirable piano touch.

8 Claims, 10 Drawing Sheets

KEYBOARD MUSICAL INSTRUMENT HAVING KEY ACTION MECHANISMS MOVABLE TO AND FROM STRINGS

RELATED APPLICATIONS

This application is a continuation-in-part of U.S. patent application Ser. No. 08/123,294 which was filed on Sep. 17, 1993.

FIELD OF THE INVENTION

This invention relates to a keyboard musical instrument and, more particularly, to a keyboard musical instrument equipped with a muting mechanism for performing a music on a keyboard without acoustic sound.

DESCRIPTION OF THE RELATED ART

A typical example of the muting mechanism incorporated in a grand piano is disclosed in Japanese Utility Model Application laid-open No. 51-67732, and the muting mechanism restricts a hammer motion with an elastic member. Namely, when a player depresses a key, the associated hammer is driven for rotation toward a set of strings, and concurrently strikes the elastic member and the strings. Then, the elastic member takes up part of the kinetic energy of the hammer so that the sound is lessened. The elastic member aims at reduction of impact against the strings, and the muting mechanism gives rise to decrease of loudness of acoustic sounds.

Of course, if the elastic member is spaced farther from the strings, the elastic member blocks the strings from the hammer, and the hammer does not strike at the strings. However, when the hammer butt is escaped from the jack, the hammer is usually as close to the strings as 2 millimeters. In this situation, if the elastic member is spaced farther, the hammer is liable to be brought into contact with the elastic member before the escape from the hammer butt, and the player feels the key-touch strange.

On the other hand, if a tuner advances the regulating button toward the jack, the hammer butt is escaped from the jack earlier, and the hammer is driven toward the strings. In this situation, the hammer is brought into contact with the elastic member after the escape from the jack, and the escape gives a kind of key-touch to the player. However, the key-touch is different from that of an acoustic piano, and the player still feels the key-touch strange. Moreover, when the elastic member is moved out of the orbit of the hammer, the hammer softly strikes the strings due to the early escape, and the sounds are like harpsichord. The motion of the hammer is slow, and the hammer can not respond to a quick repetition.

SUMMARY OF THE INVENTION

It is therefore an important object of the present invention to provide a keyboard musical instrument which is free from the problems inherent in the prior art keyboard musical instrument.

To accomplish the object, the present invention proposes to move a keyboard in an up-and-down direction together with key action mechanisms and hammer assemblies.

In accordance with one aspect of the present invention, there is provided a keyboard musical instrument comprising having a silent mode for fingering without acoustic sound and an acoustic sound mode for producing acoustic sounds through the fingering: a) a keyboard having a plurality of keys assigned respective notes of a scale and movable between a rest position and an end position, and allowing a player to finger thereon; b) a movable key bed mounting the keyboard; c) a plurality sets of strings respectively assigned the notes; d) a plurality of hammer assemblies associated with the plurality sets of strings, and rotatable around respective axes for striking the associated sets of strings, the axes being stationary with respect to the movable key bed; e) a plurality of key action mechanisms associated with the plurality of hammer assemblies, respectively, and respectively linked with the plurality of keys for driving the associated hammer assemblies through predetermined motions with respect to respective centers, the centers being stationary with respect to the movable key bed; f) a stopper movable into orbits of the hammer assemblies in the silent mode for blocking the plurality sets of strings from the associated hammer assemblies and out of the orbits in the acoustic sound mode for allowing the plurality of hammer assemblies to strike the associated sets of strings; and g) a driving means connected with the movable key bed, and operative to move the movable key bed downwardly in the silent mode for spacing the axes from the plurality sets of strings and upwardly in the acoustic sound mode for advancing the axes toward the plurality sets of strings.

The keyboard musical instrument may have a dummy load means for applying a dummy load equivalent to a load of a damper mechanism to a key in the silent mode of operation.

BRIEF DESCRIPTION OF THE DRAWINGS

The features and advantages of the keyboard musical instrument according to the present invention will be more clearly understood from the following description taken in conjunction with the accompanying drawings in which.

DESCRIPTION OF THE PREFERRED EMBODIMENTS

First Embodiment

Figure 1:
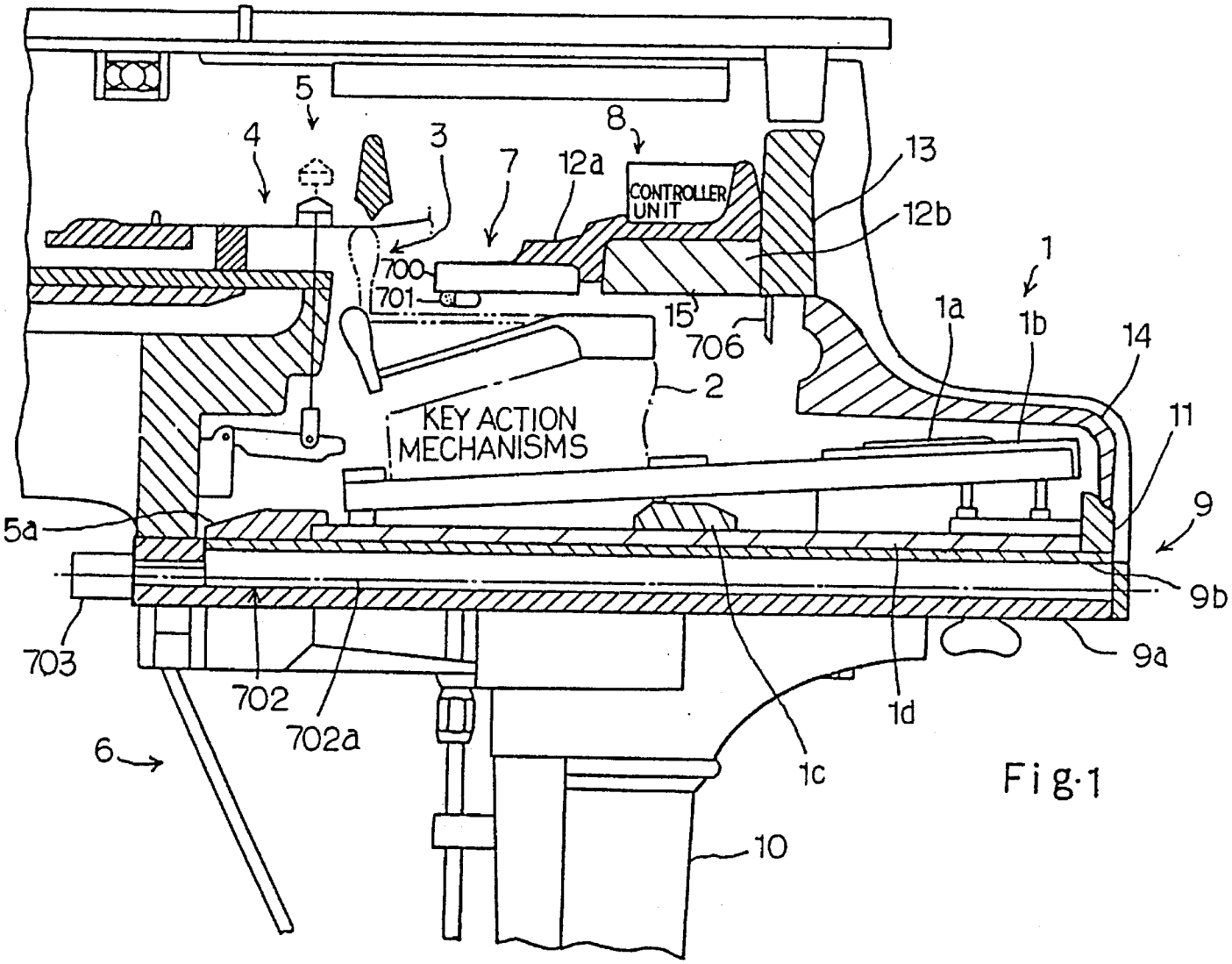
FIG. 1 is a partially cut-away side view of a grand piano according to the present invention.

Referring first to FIG. 1 of the drawings, a grand piano embodying the present invention largely comprises a keyboard 1, a plurality of key action mechanisms 2, a plurality of hammer assemblies 3, a plurality sets of strings 4, a plurality of damper assemblies 5, a pedal mechanism 6, a muting mechanism 7 and a controlling system 8, and selectively enters a silent mode and an acoustic sound mode of operation. In the following description, words "front" and "rear" are indicative of relative positions spaced from a player by short distance and by long distance, and words "clockwise" and "counter clockwise" are determined on the paper where the related structure is illustrated.

The keyboard 1 is implemented by a plurality of black and white keys 1*a* and 1*b* rockable with respect to a balance rail 1*c* on a key frame 1*d*. The notes of a scale are respectively assigned to the black and white keys 1*a* and 1*b* as well as to the sets of strings 4, and the black and white keys 1*a* and 1*b* are swingable between a rest position and an end position. The black and white keys 1*a* and 1*b* are respectively linked with the key action mechanisms 2, and the key action mechanisms 2 are respectively associated with the hammer assemblies 3 and with the sets of strings. The black and white keys 1*a* and 1*b* are further associated with the damper assemblies 5, and the damper assemblies are driven by the associated black and white keys 1*a* and 1*b* on the way from the rest position to the end position.

When one of the black and white keys 1*a* and 1*b* is depressed, the associated key action mechanism 2 drives the associated hammer assembly 3 for rotation, and the hammer assembly 3 strikes at the associated set of strings. While the key is staying at the rest position, the damper assembly 5 is held in contact with the associated set of strings. However, while the key is moving toward the rest position, the key pushes the damper assembly 5, and leaves the damper assembly 5 from the associated set of strings, thereby allowing the set of strings 4 to vibrate upon the strike with the hammer assembly 3.

The key frame 1*d* forming a part of the keyboard 1 is mounted on a key bed structure 9, and is fixed at the rear end thereof to the key bed structure 9 by means of a dag 5*a* of the damper assemblies 5. The key bed structure 9 is constituted by a lower key bed 9*a* stationary with respect to a leg 10 and an upper key bed 9*b* movable with respect to the lower key bed 9*a*, and the upper key bed 9*b* is formed from a stainless steel plate of several millimeters thick. The front end of the key frame 1*d* is held in contact with a key slip 1l, and the key slip 11 is fixed to the upper key bed 9*b*. For this reason, the keyboard 1 is movable in an up-and-down direction together with the upper key bed 9*b* with respect to the lower key bed 9*a*.

Figure 2:
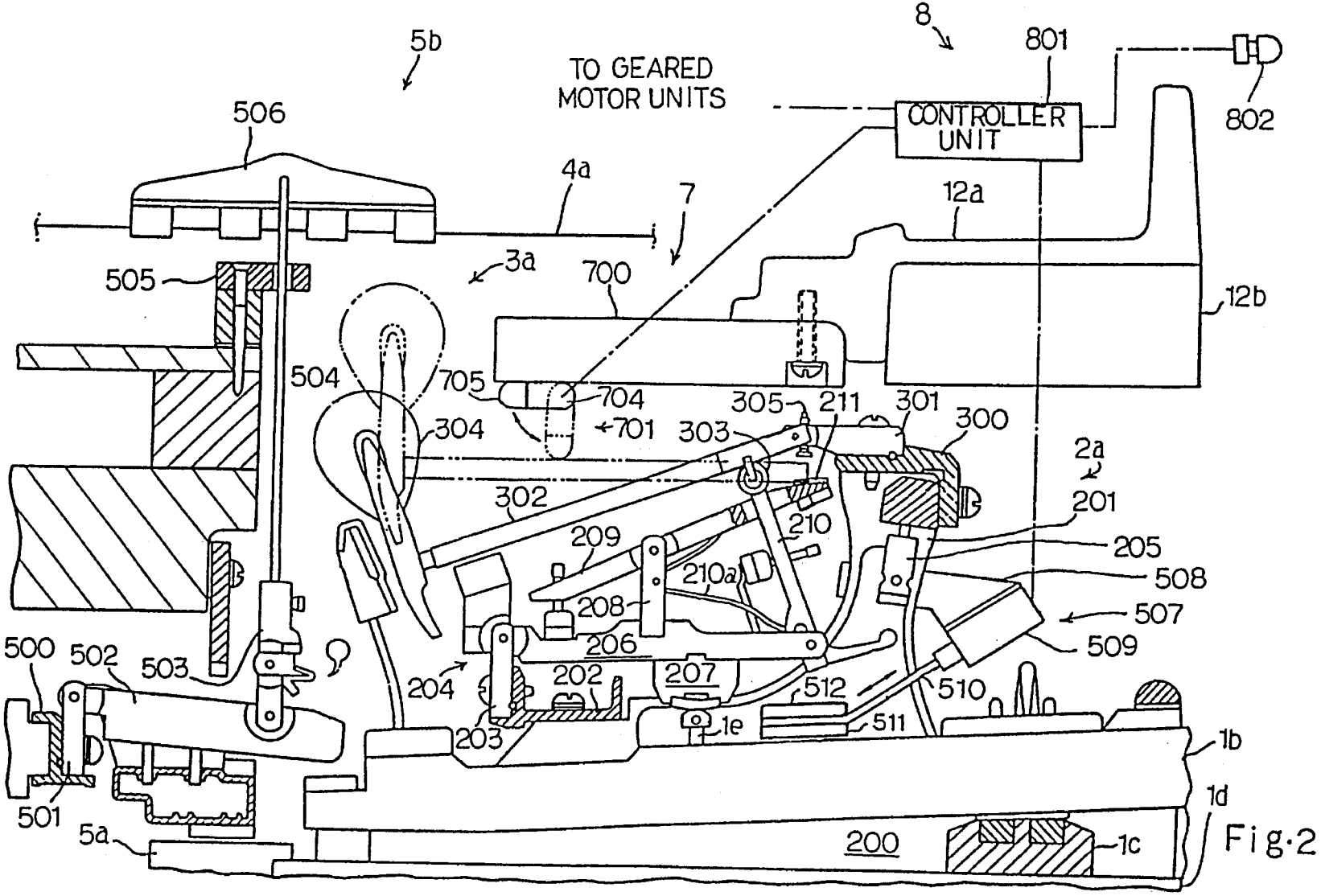
FIG. 2 is a partially cut-away side view showing a key action mechanism and a hammer assembly incorporated in the grand piano according to the present invention.

Turning to FIG. 2 of the drawings, one of the key action mechanisms 2 is linked with a capstan button 1*e* of the key 1*b*, and the associated hammer assembly 3*a* is provided for striking a set of strings 4*a* horizontally stretched.

The key action mechanism 2*a* largely comprises a bracket block 200 mounted on the key frame 1*d*, an action bracket 201 fixed to the bracket block 200, a whippen rail 202 extending over the keys 1*a* and 1*b* and bolted to the action bracket 201, a whippen flange 203 fixed to the whippen rail 202, a whippen assembly 204 turnable around the whippen flange 203, a regulating button 205 fixed to the action bracket 201 in opposing relation with the whippen assembly 204, and a back check implanted in the rear portion of the key 1*b*. If the key 1*b* is depressed, the whippen assembly 204 pushes up the hammer assembly 3*a* until contact with the regulating button 205. After the contact with the regulating button 205, the whippen assembly 204 kicks the hammer assembly 3*a*, and the hammer assembly 3*a* rushes toward the set of strings 4*a*.

In detail, the whippen assembly 204 comprises a whippen 206 turnably supported at the rear end thereof by the whippen flange 203, a whippen heel 207 fixed to the lower surface of the whippen 206, a repetition flange 208 fixed to the intermediate portion of the whippen 206, a repetition lever 209 swingably supported by the repetition flange 208, a jack 210 turnably supported by the front end of the whippen 206 and a repetition lever skin 211 bonded to the repetition lever 209 in opposing relation to the regulating screw 305. The capstan button 1*e* is held in contact with the whippen heel 207, and transmits the motion of key 1*b* to the key action mechanism 2*a*. The jack 210 has a generally L-shaped configuration, and is, accordingly, constituted by a long portion and a short portion. The long portion of the jack 210 passes through a hollow space in the whippen 206, and is brought into contact with the hammer assembly 3*a*. The capstan button 1*e* pushes up the whippen 206 during the downward motion of the key 1*b*, and the whippen 206 turns around the whippen flange 203 in the counter clockwise direction. The jack 210 turns around the whippen flange 203 together with the whippen 206, and the hammer assembly 3*a* slowly turns in the clockwise direction. However, when the short portion of the jack 210 comes into contact with the regulating button 205, the jack 210 per se turns around the whippen 206 in the counter clockwise direction against a repetition spring 210*a*, and, finally, kicks the hammer assembly 3*a*. The hammer assembly 3*a* thus escaped from the jack 210 turns toward the set of strings 4*a* at high speed, and strikes the strings 4*a*.

The hammer assembly 3*a* comprises a shank flange rail 300 bolted to the action bracket 201 and shared between the hammer assemblies 3, a shank flange 301 bolted to the shank flange rail 300, a hammer shank 302 turnable around the shank flange 301, a hammer roller 303 rotatably supported by the hammer shank 302, and a hammer head 304 fixed to the leading end of the hammer shank 302. A regulating screw 305 is opposite to the repetition lever 209. Before the short portion of the jack 210 comes into contact with the regulating button 205, the hammer roller 303 is held in rolling contact with the long portion of the jack 210. However, when the jack 210 kicks the hammer roller 303, the hammer assembly 3*a* is escaped from the jack 210, and rushes toward the set of strings 4*a*.

One of the damper assemblies 5 is associated with the key 1*b*, and is designated in its entirety by reference 5*b* in FIG. 2. The damper assembly 5*b* comprises a damper lever rail 500 shared between the damper assemblies, a damper lever flange 501 fixed to the damper lever rail 500, a damper lever 502 turnably supported by the damper lever flange 501, a damper block 503 pivotally connected with the damper lever 502, a damper wire 504 projecting from the damper block 503 through a damper guide rail 505, a damper head 506 connected with the leading end of the damper wire 504 and a dummy load mechanism 507.

The damper lever rail 500 is stationary with respect to a frame 12*a* and the leg 10, and is not linked with the upper key bed 9b. For this reason, even though the upper key bed 9b is moved in the up-and-down direction, the damper assembly 5a does not follow the upper key bed 9b.

While the upper key bed 9b and, accordingly, the keyboard 1 are lifted with respect to the lower key bed 9a, the rear end of the key 1b is engageable with the damper lever 502. Namely, while the key 1b stays in the rest position, the damper lever 502 is pushed down due to the self-weight, and the damper head 506 is held in contact with the associated set of strings 4a for damping the strings. The leading end portion of the damper lever 502 is spaced from the rear end portion of the key 1b. When the key 1b is depressed, the key 1b is moving from the rest position to the end position, and the rear end of the key 1b comes into contact with the damper lever 502. The key 1b pushes up the damper lever 502, and the damper lever 502 turns around the damper lever flange 501 in the counter clockwise direction. The damper wire 504 and the damper head 506 are lifted by the damper lever 502, and the damper head 506 is left from the set of strings 4a. As a result, the strings 4a are allowed to vibrate upon a strike with the hammer assembly 3a. However, the dummy load mechanism 507 does not apply any load to the key 1b. The damper lever flange 501, the damper lever 502, the damper block 503, the damper wire 504 and the damper head 506 as a whole constitute a damper mechanism associated with the set of strings 4a.

Although a damper pedal of the pedal mechanism 6 can keep the damper head 506 off, no further description is incorporated hereinbelow, because relation between the damper pedal sub-mechanism and a damper assembly is known to those skilled in the art.

On the other hand, when the upper key bed 9b and the keyboard 1 are sunk, the damper lever 502 is spaced farther from the rear end portion of the key 1b, and is never brought into contact with the key 1b. In other words, even if the key 1b reaches the end position, the damper lever 502 is still spaced from the rear end portion of the key 1b, and the damper head 506 is not left from the set of strings 4a. However, the dummy load mechanism 507 provides resistance against the motion of the key 1b instead of the damper lever 502 and the components connected thereto.

The dummy load mechanism 507 is supported through a bracket 508 by the action bracket 201, and comprises a solenoid-operated actuator unit 509, a blade spring 510 connected with the plunger of the solenoid-operated actuator unit 509, a cushion member 511 bonded to the lower surface of the blade spring 510, and a weight member 512 fixed to the upper surface of the blade spring 510. The elasticity of the blade spring 510 and the weight member 512 are arranged in such a manner as to produce a dummy load or the resistance against the key motion as much as the load of the damper mechanism on the key 1b.

The solenoid-operated actuator unit 509 is energized and deenergized by a controller unit 801, and the plunger and, accordingly, the blade spring 510 projects from and retracts into the solenoid case of the actuator 509. The controller unit 801 forms a part of the controlling system 8, and is shared with the muting mechanism 7 as described hereinbelow.

The muting mechanism 7 comprises a bracket member 700 bolted to the frame 12a connected with a pin block 12b, a shank stopper 701 turnably supported by post members outside the frame 12a, and a plurality of eccentric rods 702 respectively coupled with geared motor units 703 (see FIG. 1). The bracket member 700 is located over the hammer assembly 3a, and the shank stopper 701 comprises a rotational bracket 704 coupled with an appropriate actuator (not shown) and a cushion member 705 bonded to the rotational bracket 704. The actuator and the geared motor units 703 are coupled with the controller unit 801, and the controller unit 801 energizes not only the solenoid-operated actuator 509 but also the actuator coupled with the rotational rod 704 and the geared motor units 703.

While the grand piano is in the acoustic sound mode, the controller unit 801 keeps the shank stopper 701 closer to the bracket member 700 as indicated by a real line, and allows the hammer assembly 3a to strike the strings 4a.

On the other hand, when the grand piano is in the silent mode, the shank stopper 701 turns as indicted by dots-and-dash line, and the hammer shank 302 comes into contact with the shank stopper 701 on the way toward the set of strings 4a. Large force is exerted to the shank stopper 701 at the impact. However, the frame 12a is so rigid that the impact can not have any influence on the grand piano.

Figure 3:
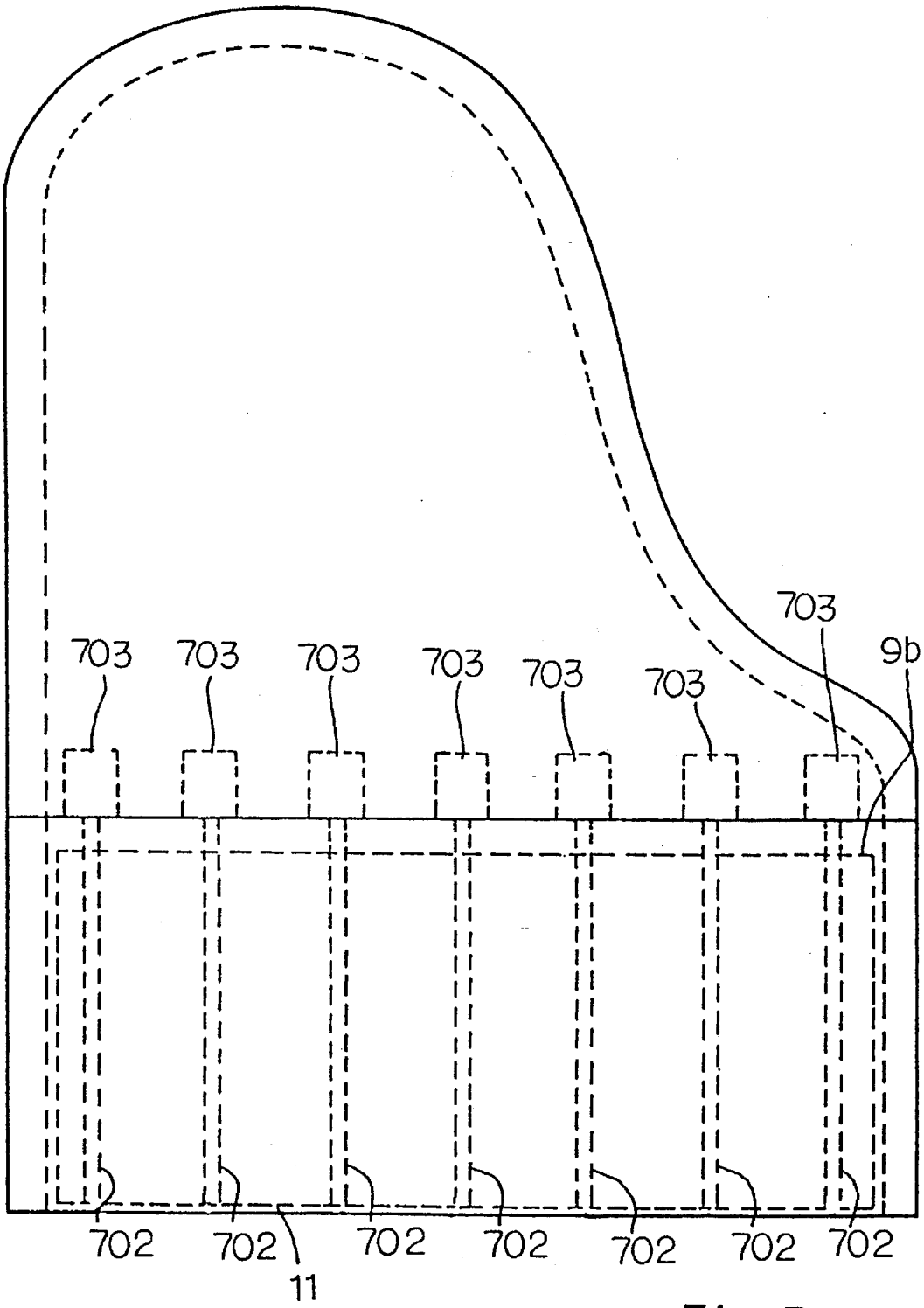
FIG. 3 is a plan view showing the arrangement of eccentric rods incorporated in the grand piano according to the present invention.

As will be better seen in FIG. 3, the seven eccentric rods 702 are arranged in parallel at intervals, and are respectively coupled with the seven geared motor units 703. The eccentric rods 702 are perpendicular to the key slip 11, and are respectively located at the bedding screws (not shown) of the keyboard 1. The eccentric rods 702 are inserted between the stationary lower key bed 9a and the movable upper key bed 9b, and the gap between the lower and upper key beds 9a and 9b is variable depending upon an angular position of the eccentric rods 702.

Figure 4:
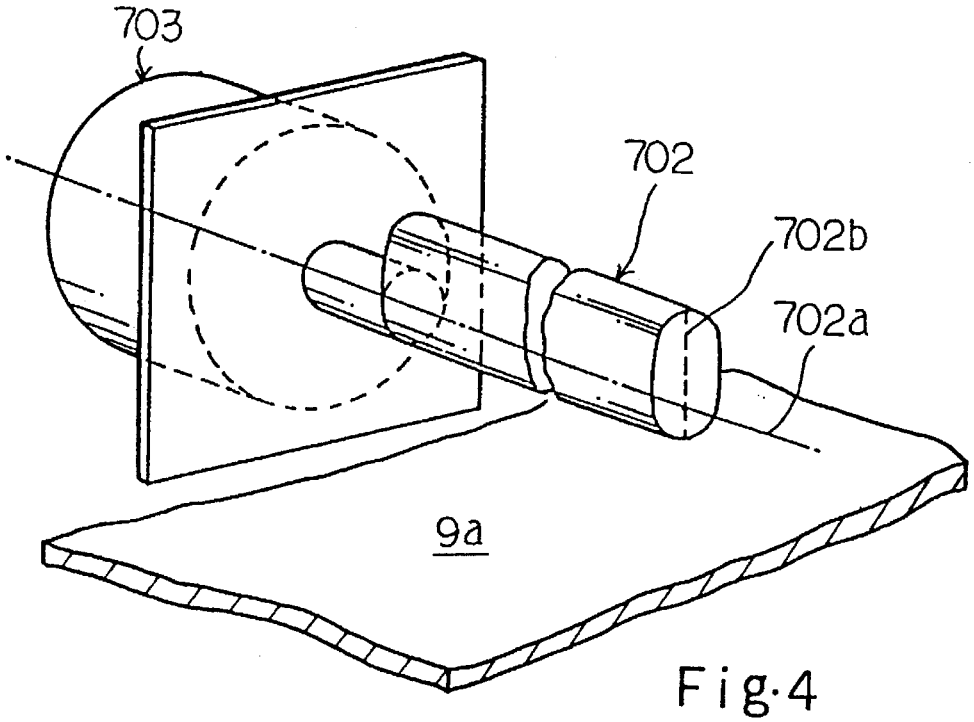
FIG. 4 is a perspective view showing the eccentric rod in an acoustic sound mode.
Figure 5:
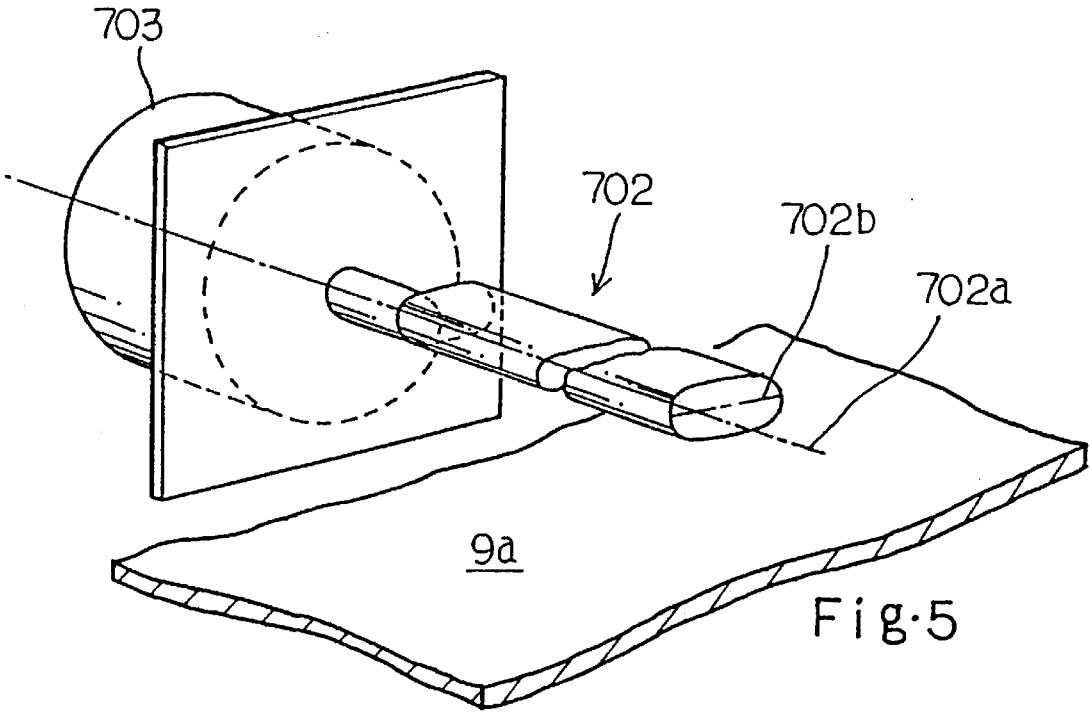
FIG. 5 is a perspective view showing the eccentric rod in a silent mode.

Each of the eccentric rods 702 has an ellipse in cross section as shown in FIGS. 4 and 5, and the rotational axis 702a of each rod 702 is on the major axis 702b of the ellipse. For this reason, the distance between the rotational axis 702 and the outer surface of the rod 702 is variable depending upon the angular position of the eccentric rod 702.

Namely, while the grand piano is in the acoustic sound mode, the geared motor unit 703 keeps the eccentric rods 702 in the first angular position where the major axis 702b is in perpendicular to the lower key bed 9b as shown in FIG. 4. Then, the movable upper key bed 9b is moved to the farthest position from the stationary lower key bed 9a, and the key board 1, the key action mechanisms 2 and the hammer assemblies 3 become the closest to the sets of strings 4 as shown in FIG. 1.

On the other hand, when the grand piano enters the silent mode, the geared motor units 703 rotate the eccentric rods 702 to the second angular position where the major axis 702b is substantially in parallel to the stationary lower key bed 9a as shown in FIG. 5. The movable upper key bed 9b goes down with the distance between the rotational axes 702a and the outer surfaces of the rods 702, and the keyboard 1, the key action mechanisms 2 and the hammer assemblies 3 are spaced farthest from the sets of strings 4. In this instance, the decrement between the first and second angular positions is about 10 millimeters. However, in case where a fall board 14 is movable together with the upper key bed 9b, undesirable gap takes place below an upper beam 13 in the second angular position, and a felt sheet 706 is hung from the upper beam 13 for interrupting the eyes of the player. For this reason, the felt sheet 706 is in the same color as the grand piano.

Of course, if the fall board 14 is supported by side arms 15, the fall board 14 is stationary, and any gap does not take place under the upper beam 13, and the felt sheet 706 is useless. However, when the upper key bed 9b goes down, a gap takes place between the fall board 14 and the keys 1a and 1b, and a felt sheet may be attached to the fall board 14.

The keyboard 1 and the key action mechanisms 2 are movable in the lateral direction with respect to the upper key bed 9b when the player steps on the shift pedal of the pedal mechanism 6. The lateral shift is about 3 millimeters, and the dag 5*a*, the key slip 11 and the key blocks may be moved together therewith.

The controlling system comprises the controller unit 801 and a switching unit 802, and the player gives an instruction for the mode, i.e., either acoustic sound or silent mode, to the controller unit 801. If the controller unit 801 is instructed to set the grand piano in the silent mode, the controller unit 801 causes the actuator to change the shank stopper 701 to the position indicated by the dots-and-dash line. The controller unit 801 energizes the geared motor units 703 so as to rotate the eccentric rods 702 from the first angular position to the second angular position, and the movable upper key bed 9*b* goes down for spacing the hammer assemblies 3 from the sets of strings 4. The controller unit 801 further energizes the solenoid-operated actuators 509 so as to advance the cushion members 511 toward the associated keys 1*a* and 1*b*, respectively.

On the other hand, when the player instructs the controller unit 801 to recover the grand piano to the acoustic sound mode. Namely, the shank stopper 701 turns to the position indicated by the real line, and the geared motor units 703 rotate the eccentric rods 702 from the second angular position to the first angular position. For this reason, the eccentric rods 702 lift the movable key bed 9*b*, the keyboard 1, the key action mechanisms 2 and the hammer assemblies 3, and the hammer heads 304 can strike the associated sets of strings 4 without any interruption of the shank stopper 701.

Description is made on performances in both acoustic sound and silent modes. Assuming now that a player wants to practice the fingering on the keyboard without acoustic sound, the player manipulates the switching unit 802, and instructs the controller unit 801 to set the grand piano in the silent mode. The shank stopper 701 becomes vertical to the lower surface of the bracket member 700, the cushion member 511 is moved closer to the key 1*b*, and the upper key bed 1*d*, the key action mechanisms 2 and the hammer assemblies 3 go down by about 10 millimeters. As a result, the tuned distance is increased from 2 to 3 millimeters to 12 to 13 millimeters.

The relative positions between the keyboard 1, the key action mechanisms 2 and the hammer assemblies 3 are unchanged. However, the relative positions of the sets of strings and the damper levers 502 are changed with respect to the keyboard 1.

The player starts a fingering on the keyboard 1, and the key 1*b* is depressed in the fingering. The key is moved from the rest position to the end position, and the capstan button 1*e* pushes up the whippen heel 207. However, the rear end portion of the key 1*b* never comes into contact with the damper lever, and the damper head 506 is continuously held in contact with the set of strings 4*a*.

While the capstan button 1*e* is pushing the whippen heel 207, the whippen 206 rotates around the whippen flange 203 in the counter clockwise direction, and the jack advances the hammer shank 302 and the hammer head 304 toward the set of strings 4*a* at relatively low speed. When the short portion of the jack 210 comes into contact with the regulating button 201, the jack 210 slightly rotates around the whippen 206 in the counter clockwise direction against the repetition spring 210*a*, and, finally, kicks the hammer roller 303. The hammer shank 302 thus escaped from the jack 210 rushes toward the set of strings 4*a*, and is brought into contact with the cushion member 705 of the stopper 701. The repetition lever skin 211 comes into contact with the repetition regulating screw 305, and the repetition lever 209 is restricted. When the hammer shank 302 comes into contact with the cushion member 705, the hammer head 304 is still spaced from the set of strings 4*a*, and never strikes thereat.

The key 1*b* comes into contact with the cushion member 511 on the way to the end position, and urges the weight 512 against the elastic force of the blade spring 510. For this reason, the weight 512 and the blade spring 510 provide the load on the key 1*b*, and the player feels the key-touch usual.

The hammer shank 302 rebounds on the cushion member 705, and the hammer assembly 3*a* returns toward the initial position 2 millimeters below the tuned point between the repetition regulating screw 305 and the repetition lever skin 211. The player releases the key 1*b*, and the key 1*b* returns from the end position toward the rest position. The hammer shank 302 is left from the cushion member 705, and rotates in the counter clockwise direction. The hammer head 304 is brought into contact with the back check 205, and the repetition lever 209 allows the jack 210 to quickly contact with the repetition roller 303 again.

On the other hand, if the player instructs the controller unit 801 to change the grand piano into the acoustic sound mode. The shank stopper 701 becomes close to the lower surface of the bracket member 700, the solenoid-operated actuator 509 retracts the blade spring 510, and the drivers 703 lifts the upper key bed 1*d*. The relative position between the keyboard 1, the key action mechanisms 2 and the hammer assemblies 3 are unchanged. However, the relative position of the keyboard 1 is changed with respect to the damper assemblies 5 and the sets of strings 4. For this reason, each hammer head 304 can strike at the associated strings without interruption of the shank stopper 701, and each key becomes engageable with the associated damper lever 502. Moreover, each cushion member 511 is far enough not to come into contact with the associated key.

While the player is performing a music on the keyboard 1, the key 1*b* is assumed to be depressed. The key 1*b* is moved from the rest position toward the end position, and the capstan button 1*e* pushes up the whippen heel 207, and the key action mechanism 2*a* behaves as similar to the silent mode.

The key 1*b* lifts the damper lever 502, and the damper lever 502 leaves the damper head 506 from the strings 4*a*. However, the key 1*b* does not come into contact with the cushion member 511.

The key action mechanism 2*a* drives the hammer assembly 3*a*, and the hammer shank 302 is escaped from the jack 210. The tuned distance between the hammer head 304 and the strings 4*a* at the escape is 2 to 3 millimeters. The hammer assembly 3*a* rotates in the clockwise direction, and rushes toward the associated set of strings 4*a*. As a result, the hammer head 304 strikes at the strings 4*a* without any interruption of the shank stopper 701. The strings vibrate, and produce an acoustic sound.

Thus, the relative positions between the keyboard 1, the key action mechanisms 2 and the hammer assembly 3 are unchanged between the silent mode and the acoustic sound mode, and the player feels the key-touch inherent in the acoustic grand piano. Moreover, the hammer shank 302 never sticks between the jack 210 and the shank stopper 701 without any early escape, and the hammer head 304 can strongly strike at the set of strings.

As will be understood from the foregoing description, the eccentric rods 702 moves the key bed structure 9 in the up-and-down direction, and the stopper 701 prevents the strings from impact with the hammer head 304 without any change of the key-touch.

Second Embodiment

Figure 6:
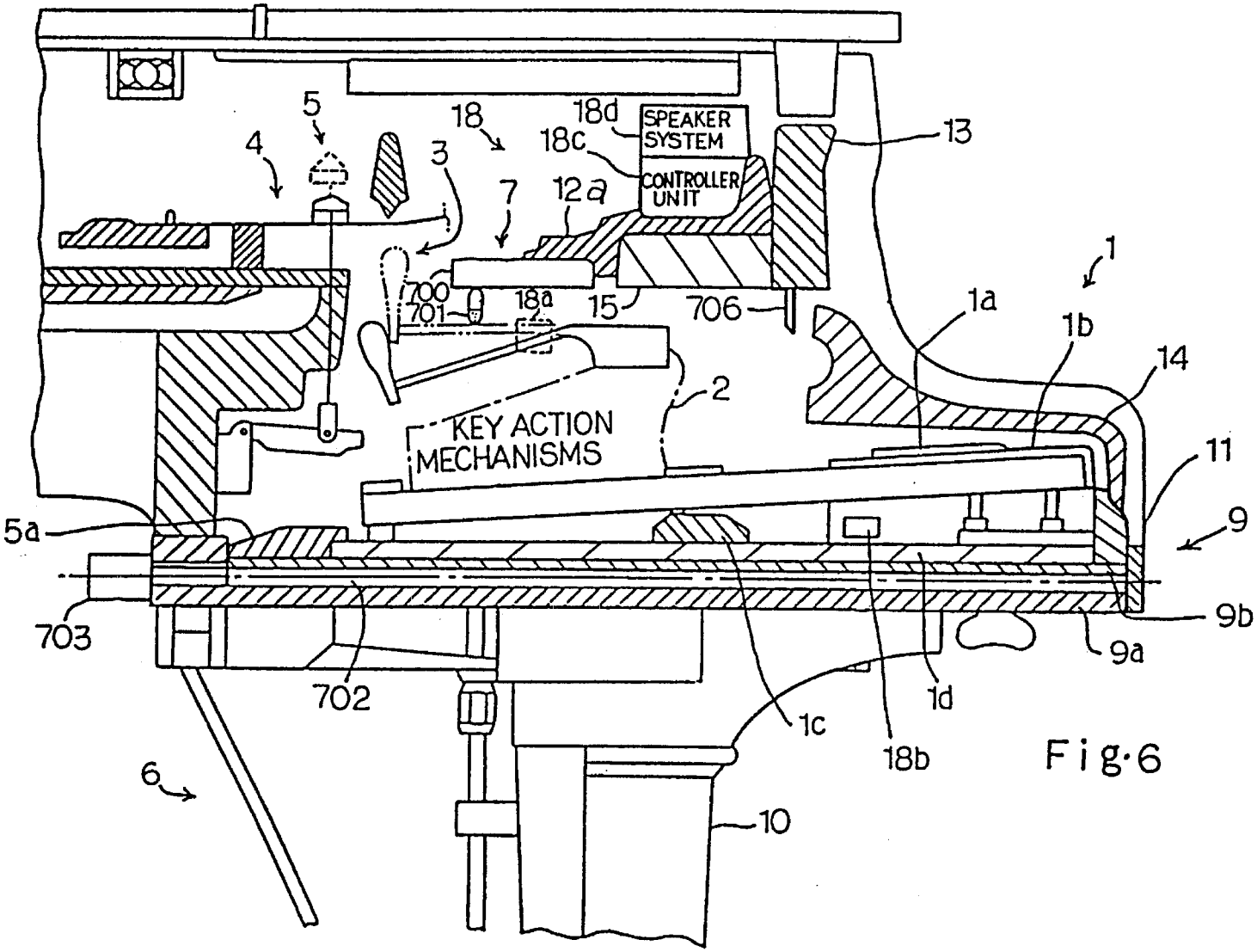
FIG. 6 is a partially cut-away side view showing a keyboard musical instrument according to the present invention.

Turning to FIG. 6 of the drawings, a keyboard musical instrument embodying the present invention largely comprises a grand piano and an electronic sound producing system 18. The grand piano is similar to the first embodiment, and components are labeled with like references without detailed description. The electronic sound producing system 18 produces synthesized sounds in the silent mode on the basis of the fingering on the keyboard 1.

The electronic sound producing system 18 comprises a plurality of hammer sensors 18*a* respectively associated with the hammer assemblies 3 for detecting hammer velocities, a plurality of key sensors 18*b* respectively associated with the keys 1*a* and 1*b* for detecting motion of the associated keys, a controller 18*c* coupled with the hammer sensors 18*a* and the key sensors 18*b* and operative to synthesize electric signals indicative of the tones assigned the depressed keys, and a speaker system 18*d* coupled with the controller 18*c* for producing synthesized sounds from the electric signals. Although the controller 18*c* serves as similar to the controller unit 801, description is focused on the electronic tone generation only. In this instance, the hammer sensors 18*a* and the key sensors 18*b* serve as a plurality of sensor means for detecting a fingering on the keyboard.

While the keyboard musical instrument is in the acoustic sound mode, the key bed structure 9, the keyboard 1, the key action mechanisms 2 and the hammer assemblies 3 are lifted, and the player can perform a music as similar to the first embodiment.

On the other hand, when the keyboard musical instrument enters the silent mode, the key bed structure 9, the keyboard 1, the key action mechanisms 2 and the hammer assemblies 3 go down, and the controller 18*c* sequentially fetches the data signals from the hammer sensors 18*a* and from the key sensors 18*b*. The controller 18*c* synthesizes the electric signals respectively indicative of the waveforms of requested sounds, and the speaker system 18*d* produces the requested sounds from the electronic signals.

Any timbre is given to the synthesized sounds, and the loudness is controllable. The electronic signals may be supplied to a headphone instead of the speaker system 18*d*. The electric signals may be formatted in accordance with the MIDI (Musical Instrument Digital Interface) code system. The electronic sound producing system 18 may be modified as similar to those disclosed in U.S. Pat. No. 4,913,026, and/or U.S. Pat. No. 4,981,066.

Third Embodiment

Figure 7:
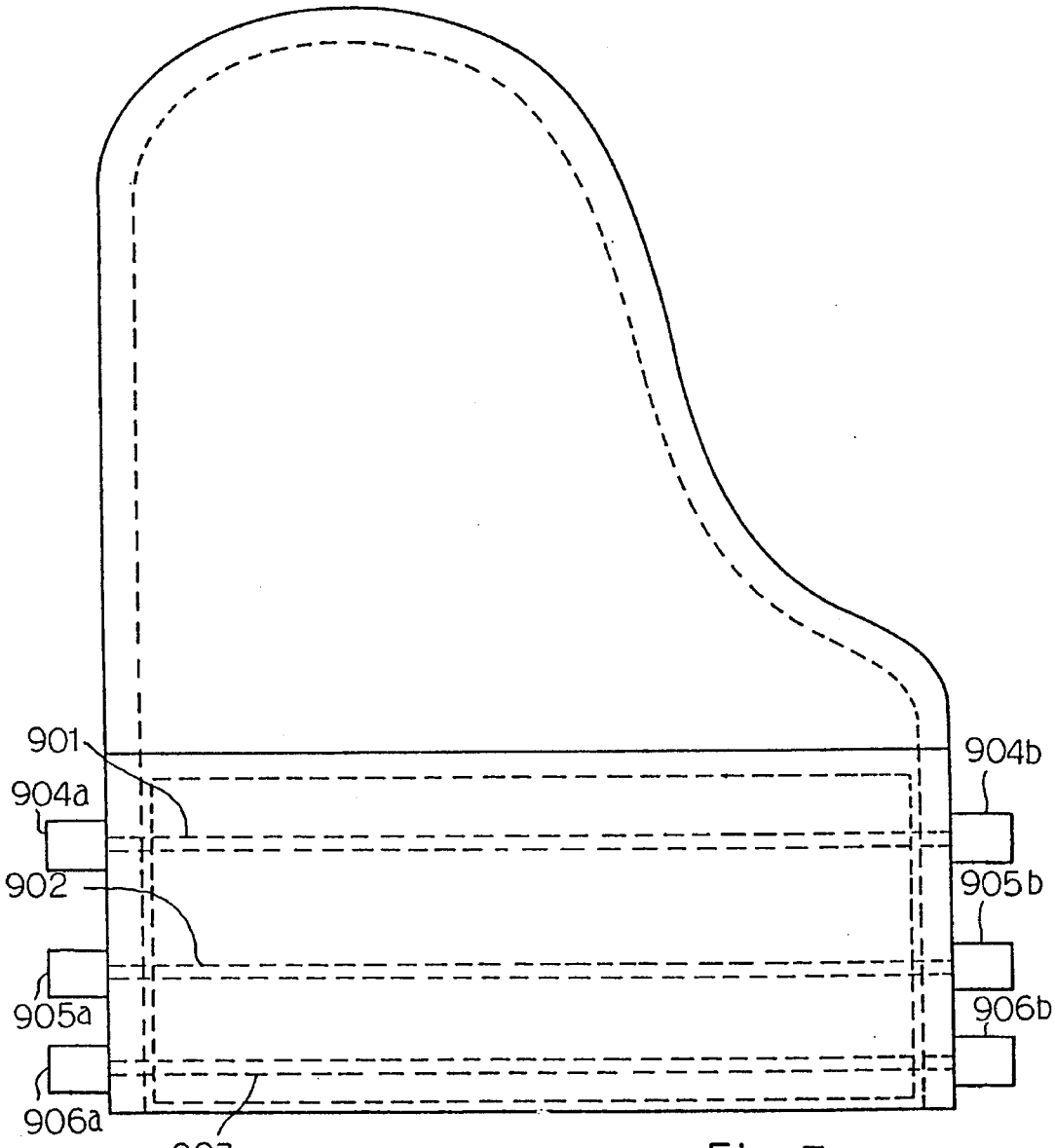
FIG. 7 is a plan view showing the arrangement of eccentric rods incorporated in another grand piano according to the present invention.

Turning to FIG. 7 of the drawings, three eccentric rods 901, 902 and 903 are incorporated in another grand piano embodying the present invention, and each eccentric rod 901, 902 or 903 is coupled at both ends thereof with a pair of geared motor units 904*a*/904*b*, 905*a*/905*b* or 906*a*/906*b*. The eccentric rods 702 coupled with the geared motor units 703 of the first embodiment are replaced with the eccentric rods 901 to 903 coupled with the three pairs of geared motor units 904*a*/904*b* to 906*a*/906*b*.

The eccentric rods 901 to 903 are inserted between the lower key bed and the upper key bed, and move the upper key bed in the up-and-down direction depending upon the mode as similar to the first embodiment. Though not shown in FIG. 7, the eccentric rods 901 to 903 are respectively aligned to a back rail, a balance rail and a front rail.

The other structure of the third embodiment is similar to the first embodiment, and the grand piano selectively enters the acoustic sound mode and the silent mode. However, no further description is incorporated for avoiding repetition.

Each of the eccentric rods 901 to 903 may be coupled with a single geared motor unit.

Fourth Embodiment

Figure 8:
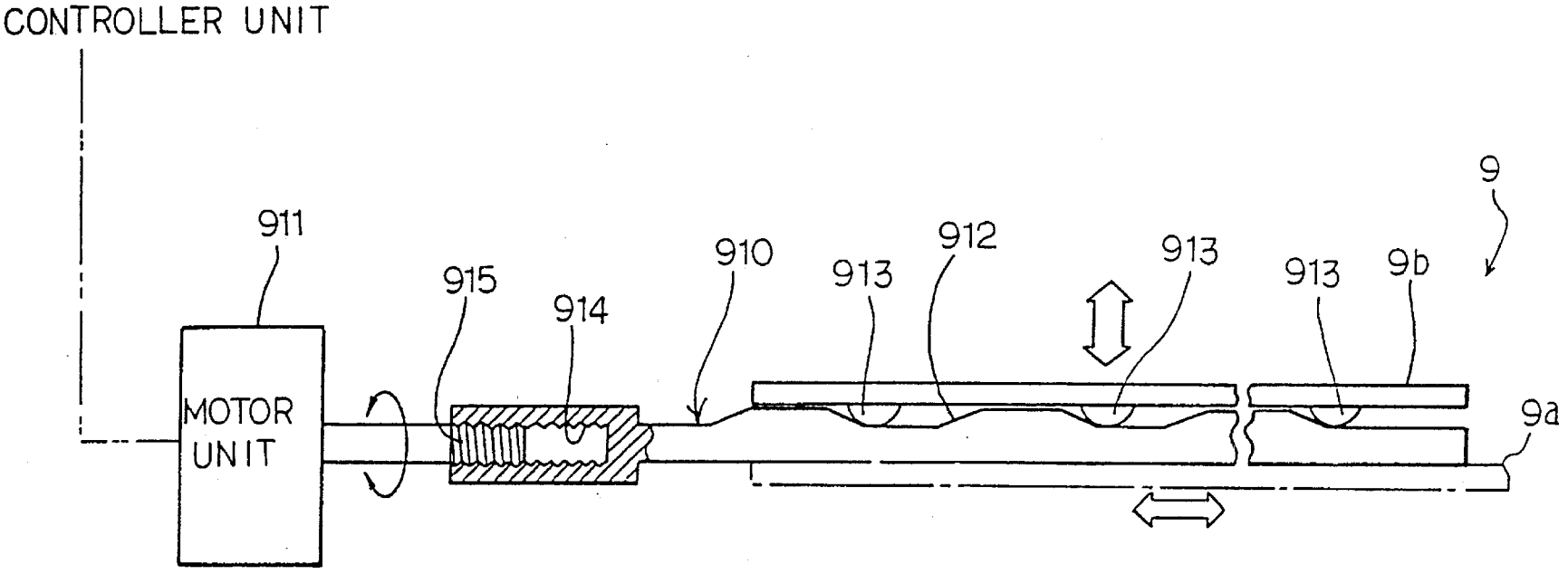
FIG. 8 is a partially cut-away front view showing an essential part of a muting mechanism incorporated in yet another grand piano according to the present invention.

Turning to FIG. 8 of the drawings, a reciprocal cam rod 910 coupled with a geared motor unit 911 is incorporated in yet another grand piano embodying the present invention, and the eccentric rods 702 coupled with the geared motor units 703 are replaced with the reciprocal cam rods respectively coupled with the geared motor units 911.

The reciprocal cam rod 910 is slidably mounted on the lower key bed 9*a*, and a cam surface 912 of the rod 910 is held in contact with round projections 913 fixed to the lower surface of the upper key bed 9*b*.

A female screw 914 is formed at one end portion of the reciprocal cam rod 910, and is engaged with a male screw 915 of the rotatable shaft of the geared motor unit 911. The female and male screws 914 and 915 as a whole constitute a transformer.

The controller unit 801 controls the rotating direction of the geared motor unit 911 depending upon the mode of operation, and the transformer changes the rotation of the shaft to a reciprocal motion of the cam rod 910. The reciprocal motion in turn is converted into a vertical motion through the cam surface 912 and the round projections 913. Therefore, the rotation of the geared motor unit 911 is finally transformed into the vertical motion of the upper key bed 9*b*.

The other components of the fourth embodiment are similar to those of the first embodiment, and no further description is incorporated hereinbelow for the sake of simplicity. The grand piano implementing the fourth embodiment achieves all the advantages of the first embodiment.

Fifth Embodiment

Figure 9:
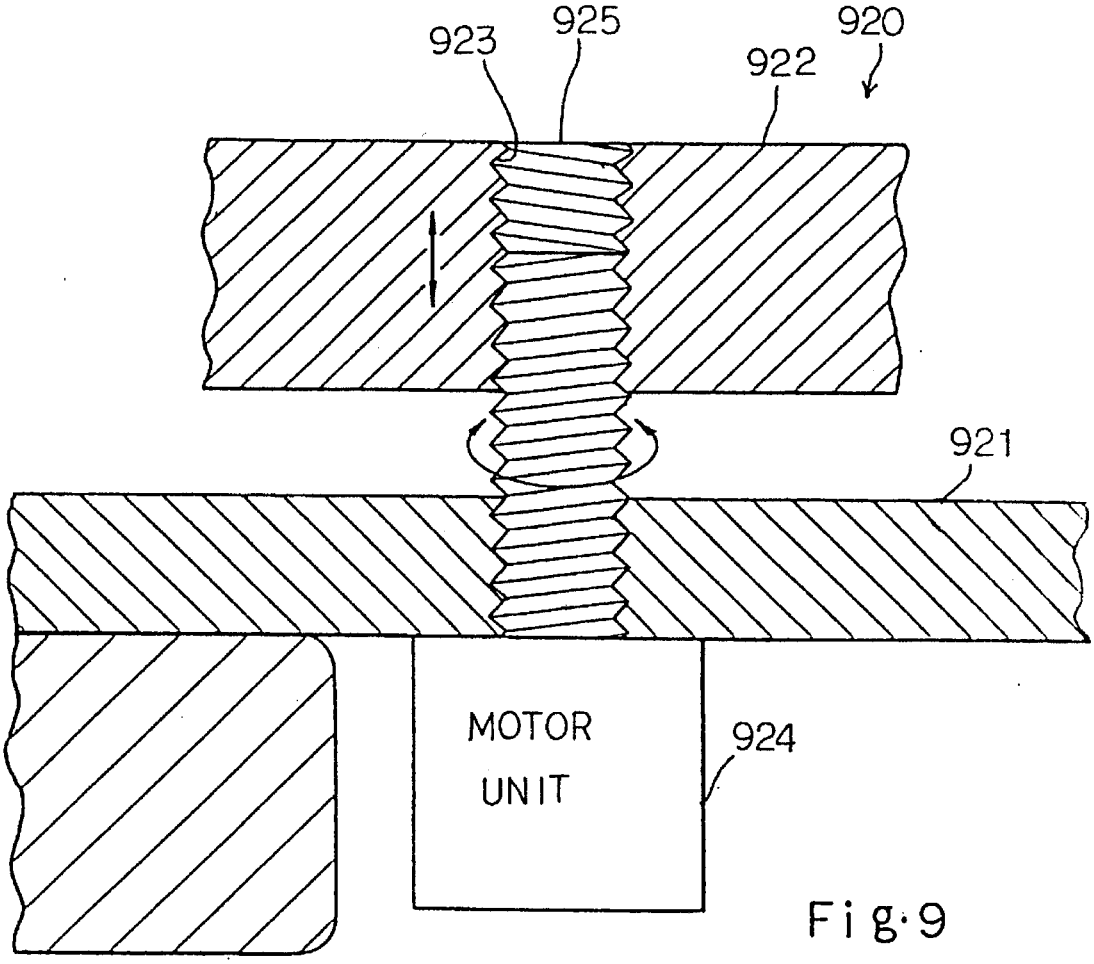
FIG. 9 a cross sectional view showing a key bed structure incorporated in still another grand piano according to the present invention.
Figure 10:
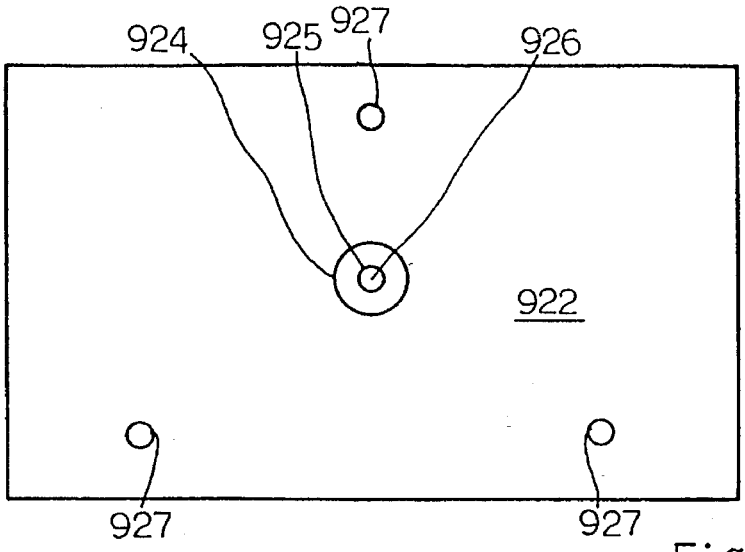
FIG. 10 is a plan view showing the location of a geared motor unit incorporated in the grand piano shown in FIG. 9.

Turning to FIG. 9 of the drawings, a key bed structure 920 is incorporated in still another grand piano embodying the present invention. The key bed structure 920 is constituted by a lower key bed 921 stationary with respect to a frame and a leg (not shown) and an upper key bed 922 movable with respect to the lower key bed 921.

The eccentric rods 702 coupled with the geared motor units 703 are replaced with a female screw 923 formed in the upper key bed 922, a geared motor unit 924 fixed to the lower key bed 921 and a male screw formed in the drive shaft of the geared motor unit 924. The male screw 925 is engaged with the female screw 923, and the geared motor unit 924 is driven for a normal rotation and a reverse rotation by the controller unit 801.

The drive shaft of the geared motor unit 924 is aligned with a center of gravity 926 of the upper key bed 922, and the center of gravity 926 is determined under the conditions where the keyboard 1, the key action mechanisms 2 and the hammer assemblies 3 are mounted on the upper key bed 922. Three guide rods 927 are provided around the center of gravity 926, and allow the upper key bed 922 to be smoothly moved in the up-and-down direction.

The other components are similar to the first embodiment, and all advantages of the first embodiment are achieved by the fifth embodiment.

Figure 11:
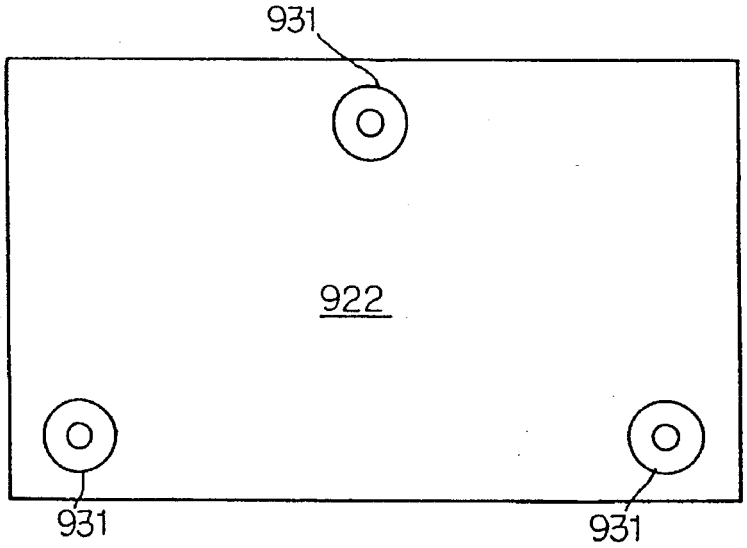
FIG. 11 is a plan view showing a modification of the grand piano shown in FIG. 9.

Although the upper key bed 922 is supported by the three guide rods 927, the single geared motor unit 924 accompanied with the guide rods 927 may be replaced with three geared motor units 931 as shown in FIG. 11.

Sixth Embodiment

Figure 12:
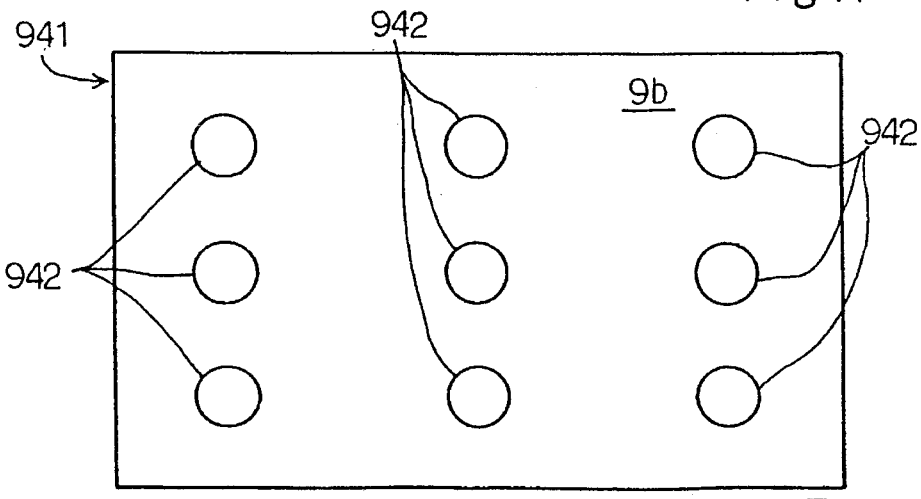
FIG. 12 is a plan view showing a lifter of a grand piano according to the present invention.
Figure 13:
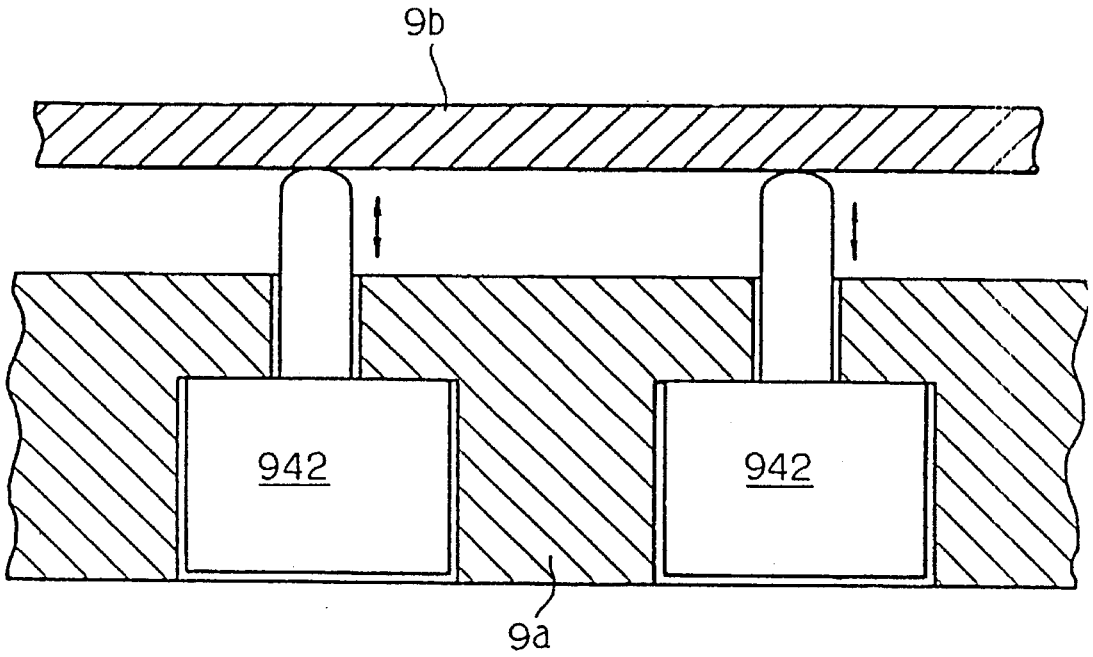
FIG. 13 is a cross sectional view showing the lifter shown in FIG. 12.

Turning to FIGS. 12 and 13 of the drawings, a lifter 941 is inserted between the lower key bed 9*a* and the upper key bed 9*b* instead of the eccentric rods 702 coupled with the geared motor units 703, and is implemented by a plurality of pushers 942 driven by the controller unit 801. The pushers 942 may be solenoid-operated actuators or electric motor units.

The other components are similar to the first embodiment, and the same advantages are achieved by the sixth embodiment.

Seventh Embodiment

Figure 14:
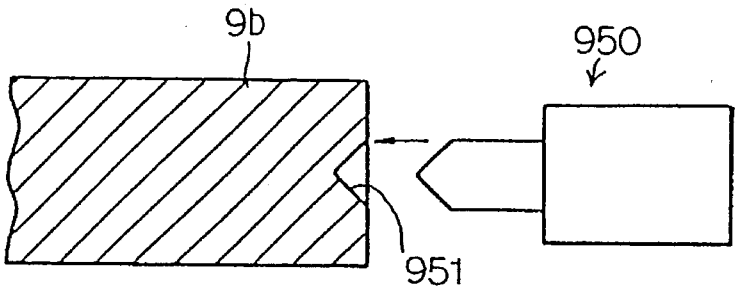
FIG. 14 is a cross sectional view showing a positioner incorporated in a grand piano according to the present invention.

Turning to FIG. 14 of the drawings, a grand piano embodying the present invention further comprises a positioner 950, and the positioner 950 is implemented by a solenoid-operated actuator. The solenoid-operated actuator has a solenoid case fixed to a post member (not shown) stationary with respect to the lower key bed, and a plunger projectable from and retractable into the solenoid case. A recess 951 is formed in the side of the upper key bed **9*b*, and the plunger is inserted into the recess 951 after the eccentric rods 702 lifts the upper key bed 9*b* for keeping the upper key bed 9*b*** at a predetermined position.

Although particular embodiments of the present invention have been shown and described, it will be obvious to those skilled in the art that various changes and modifications may be made without departing from the spirit and scope of the present invention. For example, the geared motor unit may be replaced with an ultra-sonic motor unit, and the ultra-sonic motor unit is desirable in view of silence. In the above described embodiments, the eccentric rods have an ellipse in cross section. However, any eccentric rod is available in so far as the distance between the rotational axis and the outer surface is varied depending upon the rotational angle. If the stopper 701 is provided without the eccentric rods 702 driven by the drivers 703, the grand piano have the acoustic sound mode and a muting mode instead of the silent mode, and a player can perform a music from weak acoustic sounds. If a suitable orthogonal transformation mechanism is inserted between a keyboard and key action mechanisms, the present invention is applicable to an upright piano.

What is claimed is:

1. A keyboard musical instrument having a silent mode and an acoustic sound mode comprising:

a) a keyboard having a plurality of keys assigned respective notes of a scale, said plurality of keys being swingably supported by a rail so as to be movable between a rest position and an end position;

b) a movable key bed mounting said keyboard;

c) a plurality of sets of strings respectively assigned said notes;

d) a plurality of hammer assemblies associated with said plurality of sets of strings, each of said plurality of hammer assemblies including means for allowing said hammer assemblies to rotate around an axis to strike at least one set of said plurality of sets of strings, said plurality of hammer assemblies being attached to said movable key bed such that said plurality of hammer assemblies move with said movable key bed and said axis of each of said plurality of hammer assemblies remains in a fixed position with respect to said movable key bed;

e) a plurality of key action mechanisms associated with said plurality of hammer assemblies and linked with said plurality of keys for driving said plurality of hammer assemblies through predetermined motions, said plurality of key action mechanisms being attached to said movable key bed such that said plurality of key action mechanisms move with said movable key bed and said predetermined motions remain in a fixed position with respect to said movable key bed;

f) a stopper movably supported by a first stationary member of said keyboard musical instrument and associated with said plurality of hammer assemblies;

g) moving means for moving said stopper between a blocking position in which said stopper blocks said plurality of hammer assemblies from striking said plurality of sets of strings while said keyboard musical instrument is in said silent mode and a non-blocking position in which said stopper allows said plurality of hammer assemblies to strike said plurality of sets of strings while said keyboard musical instrument is in said acoustic sound mode; and h) driving means for moving said movable key bed away from said plurality of sets of strings when said keyboard musical instrument is placed in said silent mode and moving said movable key bed toward said plurality of sets of strings when said keyboard musical instrument is placed in said acoustic sound mode, said driving means comprising:

a stationary key bed provided under said movable key bed, projections attached to a lower surface of said movable key bed, at least one reciprocal cam rod inserted between said movable key bed and said stationary key bed, and having a cam surface held in contact with said projections attached to the lower surface of said movable key bed, a driver selectively rotating in either of a first direction or a second direction opposite the first direction, and a transformer coupled between said driver and said reciprocal cam rod, and changing said rotation of said driver into a reciprocal motion of said reciprocal cam rod.

2. A keyboard musical instrument having a silent mode and an acoustic sound mode comprising:

a) a keyboard having a plurality of keys assigned respective notes of a scale, said plurality of keys being swingably supported by a rail so as to be movable between a rest position and an end position;

b) a movable key bed mounting said keyboard;

c) a plurality of sets of strings respectively assigned said notes;

d) a plurality of hammer assemblies associated with said plurality of sets of strings, each of said plurality of hammer assemblies including means for allowing said hammer assemblies to rotate around an axis to strike at least one set of said plurality of sets of strings, said plurality of hammer assemblies being attached to said movable key bed such that said plurality of hammer assemblies move with said movable key bed and said axis of each of said plurality of hammer assemblies remains in a fixed position with respect to said movable key bed;

e) a plurality of key action mechanisms associated with said plurality of hammer assemblies and linked with said plurality of keys for driving said plurality of hammer assemblies through predetermined motions plurality of key action mechanisms being attached to said movable key bed such that said plurality of key action mechanisms move with said movable key bed and said predetermined motions remain in a fixed position with respect to said movable key bed;

f) a stopper movably supported by a first stationary member of said keyboard musical instrument and associated with said plurality of hammer assemblies;

g) moving means for moving said stopper between a blocking position in which said stopper blocks said plurality of hammer assemblies from striking said plurality of sets of strings while said keyboard musical instrument is in said silent mode and a non-blocking position in which said stopper allows said plurality of hammer assemblies to strike said plurality of sets of strings while said keyboard musical instrument is in said acoustic sound mode; and h) driving means for moving said movable key bed away from said plurality of sets of strings when said keyboard musical instrument is placed in said silent mode and moving said movable key bed toward said plurality of sets of strings when said keyboard musical instrument is placed in said acoustic sound mode, said driving means comprising:

a stationary member provided under said movable key bed, a lifter coupled with said movable key bed, and a driver supported by said stationary member and connected to said lifter and causing said lifter to reciprocally move said movable key bed.

3. The keyboard musical instrument as set forth in claim 2, in which said driver comprises a motor unit having a drive shaft formed with a male screw, said lifter comprises a female screw formed in said movable key bed and engaged with said male screw, and said motor unit is bidirectionally driven for a rotation, a rotational axis of said drive shaft being aligned with a center of gravity of the movable key bed under conditions where said keyboard, said plurality of key action mechanisms and said plurality of hammer assemblies are supported by said movable key bed.

4. The keyboard musical instrument as set forth in claim 2, in which said lifter comprises a plurality of female screws formed in said movable key bed, and a plurality of motors driven for a normal rotation and a reverse rotation, and having respective drive shafts engaged with said female screws.

5. The keyboard musical instrument as set forth in claim 2, in which said lifter comprises a plurality of pushers inserted between said movable key bed and said stationary member.

6. A keyboard musical instrument having a silent mode and an acoustic sound mode comprising:

a) a keyboard having a plurality of keys assigned respective notes of a scale, said plurality of keys being swingably supported by a rail so as to be movable between a rest position and an end position;

b) a movable key bed mounting said keyboard;

c) a plurality of sets of strings respectively assigned said notes;

d) a plurality of hammer assemblies associated with said plurality of sets of strings, each of said plurality of hammer assemblies including means for allowing said hammer assemblies to rotate around an axis to strike at least one set of said plurality of sets of strings, said plurality of hammer assemblies being attached to said movable key bed such that said plurality of hammer assemblies move with said movable key bed and said axis of each of said plurality of hammer assemblies remains in a fixed position with respect to said movable key bed;

e) a plurality of key action mechanisms associated with said plurality of hammer assemblies and linked with said plurality of keys for driving said plurality of hammer assemblies through predetermined motions plurality of key action mechanisms being attached to said movable key bed such that said plurality of key action mechanisms move with said movable key bed and said predetermined motions remain in a fixed position with respect to said movable key bed;

f) a stopper movably supported by a first stationary member of said keyboard musical instrument and associated with said plurality of hammer assemblies;

g) moving means for moving said stopper between a blocking position in which said stopper blocks said plurality of hammer assemblies from striking said plurality of sets of strings while said keyboard musical instrument is in said silent mode and a non-blocking position in which said stopper allows said plurality of hammer assemblies to strike said plurality of sets of strings while said keyboard musical instrument is in said acoustic sound mode;

h) driving means for moving said movable key bed away from said plurality of sets of strings when said keyboard musical instrument is placed in said silent mode and moving said movable key bed toward said plurality of sets of strings when said keyboard musical instrument is placed in said acoustic sound mode;

a board member stationary with respect to said movable key bed; and a positioner supported by said board member and engageable with said movable key bed for keeping said movable key bed at a predetermined position while said keyboard musical instrument is in said silent mode.

7. The keyboard musical instrument as set forth in claim 3, in which said driving means further comprises a plurality of guide rods connected to said movable key bed and passing through said stationary member.

8. A keyboard musical instrument comprising: a keyboard, wherein:

the keyboard includes a plurality of keys assigned respective musical notes and each of the plurality of keys is movably supported by a rail so as to be movable between a rest position and a pressed position;

the musical instrument has a silent mode in which the plurality of keys may be moved from the rest position to the pressed position without generating acoustic sounds and an acoustic sound mode in which acoustic sounds are produced when one of the plurality keys is moved from the rest position to the pressed position;

a movable key bed mounting said keyboard wherein said movable key bed is movable to an acoustic playing position and a silent playing position;

a plurality of acoustic sound producing members wherein one of the acoustic sound producing members corresponds to one of the plurality of keys;

a plurality of contact assemblies each of which is connected and responsive to one of said plurality of keys, wherein each of said plurality of contact assemblies includes a contact member for optionally contacting a respective one of the plurality of acoustic sound producing members in response to movement of one of said plurality of keys corresponding to the respective one of the plurality of acoustic sound producing members;

a plurality of action mechanisms linking the plurality of keys with the plurality of contact assemblies, wherein when one of the plurality of keys is moved from the rest position to the pressed position, the contact member of the contact assembly that is connected to said one of the plurality of keys is engaged by a respective action mechanism and moved along a predetermined path;

a movable stopper supported by a first stationary member of said keyboard musical instrument and associated with said plurality of contact assemblies moving means for moving said movable stopper into a blocking position in said silent mode for blocking the contact members from contacting respective ones of said acoustic sound producing members; and driving means connected with said movable key bed, and operative to displace the movable key bed in the silent mode to said silent playing position and to said acoustic playing position in the acoustic sound mode, said driving means including:

a stationary member adjacent said movable key bed, and a driver supported by said stationary member and engageable with said movable key bed for positioning the key bed.

* * * * *